US012473068B2

(12) United States Patent
Tagata et al.

(10) Patent No.: US 12,473,068 B2
(45) Date of Patent: Nov. 18, 2025

(54) MARINE PROPULSION SYSTEM AND MARINE VESSEL

(71) Applicant: YAMAHA HATSUDOKI KABUSHIKI KAISHA, Iwata (JP)

(72) Inventors: Akihiro Tagata, Shizuoka (JP); Yoshinori Yagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 49 days.

(21) Appl. No.: 18/743,166

(22) Filed: Jun. 14, 2024

(65) Prior Publication Data

US 2025/0019060 A1 Jan. 16, 2025

(30) Foreign Application Priority Data

Jul. 10, 2023 (JP) ..... 2023-113340

(51) Int. Cl.
*B63B 1/26* (2006.01)
*B63B 79/40* (2020.01)
*B63H 21/21* (2006.01)

(52) U.S. Cl.
CPC ..... *B63H 21/213* (2013.01); *B63B 79/40* (2020.01); *B63H 2021/216* (2013.01)

(58) Field of Classification Search
CPC ..... B63B 1/246; B63B 1/26; B63B 1/285; B63B 1/248; B63B 9/40; B63H 21/213; B63H 2021/216
See application file for complete search history.

(56) References Cited

U.S. PATENT DOCUMENTS

| | | | | |
|---|---|---|---|---|
| 9,580,150 | B2 * | 2/2017 | Lee | B63B 79/00 |
| 10,723,431 | B1 * | 7/2020 | Przybyl | G01S 19/52 |
| 10,864,977 | B2 * | 12/2020 | Murru | B63H 25/04 |
| 11,254,402 | B1 * | 2/2022 | Poirier | F02D 41/10 |
| 11,414,162 | B2 * | 8/2022 | Inoue | B63B 39/061 |
| 11,453,467 | B2 * | 9/2022 | Inoue | B63B 39/061 |
| 12,030,609 | B2 * | 7/2024 | Tsuchiya | B63H 25/42 |
| 12,252,225 | B2 * | 3/2025 | Hamada | B63B 79/40 |
| 12,325,497 | B2 * | 6/2025 | Amma | B63C 9/0005 |
| 2004/0242091 | A1 | 12/2004 | Okuyama et al. | |

(Continued)

FOREIGN PATENT DOCUMENTS

| | | |
|---|---|---|
| EP | 3639105 B1 | 5/2023 |
| JP | 63-193999 U | 12/1988 |

(Continued)

OTHER PUBLICATIONS

Prempraneerach et al., Autonomous way-point tracking navigation of surveying surface vessel with real-time positioning system, 2015, IEEE, p. 1-6 (Year: 2015).*

(Continued)

*Primary Examiner* — McDieunel Marc
(74) *Attorney, Agent, or Firm* — Keating & Bennett, LLP

(57) ABSTRACT

A marine propulsion system includes a controller configured or programmed to temporarily cancel an in-wave vessel speed control mode, in which an in-wave vessel speed control is performed to adjust a vessel speed based on information regarding upward-downward movement of a hull when waves are occurring, for a predetermined period of time when an operator is operated to cancel the in-wave vessel speed control mode.

20 Claims, 6 Drawing Sheets

(56) References Cited

U.S. PATENT DOCUMENTS

| | | | | |
|---|---|---|---|---|
| 2019/0023368 | A1* | 1/2019 | Andrasko | G05D 1/0875 |
| 2021/0155332 | A1* | 5/2021 | Van Dyke | B63H 20/10 |
| 2021/0394877 | A1 | 12/2021 | Kadota et al. | |
| 2021/0394883 | A1 | 12/2021 | Kadota et al. | |
| 2023/0339582 | A1 | 10/2023 | Moromi | |
| 2023/0339588 | A1 | 10/2023 | Tsurumi | |

FOREIGN PATENT DOCUMENTS

| | | | |
|---|---|---|---|
| JP | 6-211190 | A | 8/1994 |
| JP | 2003-154993 | A | 5/2003 |
| JP | 4190855 | B2 | 12/2008 |
| JP | 2021195076 | A | 12/2021 |
| JP | 2021195077 | A | 12/2021 |
| JP | 2023-160045 | A | 11/2023 |
| JP | 2023-160046 | A | 11/2023 |

OTHER PUBLICATIONS

Luo et al., Control System Design and Thrust Analysis of an Unmanned Surface Cleaning Vessel With a Novel Pump-Valve Propulsion System, 2020, IEEE, p. 1-17 (Year: 2020).*

Kragelund et al., Adaptive speed control for autonomous surface vessels, 2013, IEEE, p. 1-10 (Year: 2013).*

Desa et al., A Small Autonomous Surface Vehicle for Ocean Color Remote Sensing, 2007, IEEE, p. 353-364 (Year: 2007).*

Official Communication issued in corresponding European Patent Application No. 24181148.8, mailed on Jan. 10, 2025, 7 pages.

* cited by examiner

MARINE PROPULSION SYSTEM AND MARINE VESSEL

CROSS REFERENCE TO RELATED APPLICATIONS

This application claims the benefit of priority to Japanese Patent Application No. 2023-113340 filed on Jul. 10, 2023. The entire contents of this application are hereby incorporated herein by reference.

BACKGROUND OF THE INVENTION

1. Field of the Invention

The present invention relates to marine propulsion systems and marine vessels.

2. Description of the Related Art

A marine propulsion system that performs a control to adjust a vessel speed based on information regarding upward-downward movement of a hull when waves are occurring is known in general. Such a marine propulsion system is disclosed in Japanese Patent Laid-Open No. 6-211190, for example.

Japanese Patent Laid-Open No. 6-211190 discloses a marine operation control device (marine propulsion system) that performs a control to adjust a vessel speed based on information regarding upward-downward movement of a hull when waves are occurring. The marine operation control device described in Japanese Patent Laid-Open No. 6-211190 detects the degree of impact received by the hull during voyage using an acceleration detector that detects the acceleration of the hull in an upward-downward direction, for example, and decelerates the hull when the acceleration of the hull in the upward-downward direction, for example, detected by the acceleration detector exceeds a preset setting limit.

While a control is performed to adjust a vessel speed based on information regarding upward-downward movement of a hull when waves are occurring as in the marine operation control device (marine propulsion system) described in Japanese Patent Laid-Open No. 6-211190, a vessel user may temporarily want to operate the hull as intended regardless of the upward-downward movement of the hull. For example, there may be a sudden need to avoid obstacles, change the route, etc., or there may be a sudden change in the direction of waves. Therefore, a structure is desired to temporarily operate the hull as intended by the vessel user regardless of the upward-downward movement of the hull while a control is performed to adjust the vessel speed based on the information regarding upward-downward movement of the hull when waves are occurring.

SUMMARY OF THE INVENTION

Example embodiments of the present invention provide marine propulsion systems and marine vessels that each allow vessel users to temporarily operate hulls as intended regardless of information regarding upward-downward movement of the hulls while a control is performed to adjust vessel speeds based on the information regarding upward-downward movement of the hulls when waves are occurring.

A marine propulsion system according to an example embodiment of the present invention includes a propulsion device to be provided on a hull, a controller configured or programmed to control driving of the propulsion device to adjust a vessel speed and perform an in-wave vessel speed control to adjust the vessel speed based on information regarding upward-downward movement of the hull, and an operator to receive an operation from a vessel user. The controller is configured or programmed to temporarily cancel an in-wave vessel speed control mode, in which the in-wave vessel speed control is performed, for a predetermined period of time when the operator is operated to cancel the in-wave vessel speed control mode.

In a marine propulsion system according to an example embodiment of the present invention, the controller is configured or programmed to temporarily cancel the in-wave vessel speed control mode, in which the in-wave vessel speed control is performed, for the predetermined period of time when the operator is operated to cancel the in-wave vessel speed control mode. Accordingly, when the vessel user operates the operator to cancel the in-wave vessel speed control mode, the in-wave vessel speed control mode is temporarily canceled for the predetermined period of time. Consequently, while a control is performed to adjust the vessel speed based on the information regarding upward-downward movement of the hull, the hull is temporarily operated as intended by the vessel user regardless of the upward-downward movement of the hull.

In a marine propulsion system according to an example embodiment of the present invention, the controller is preferably configured or programmed to return to the in-wave vessel speed control mode when the predetermined period of time has elapsed since the in-wave vessel speed control mode was temporarily canceled. Accordingly, when the predetermined period of time has elapsed since the in-wave vessel speed control mode was canceled, the controller automatically returns to the in-wave vessel speed control mode, and thus a structure in which the in-wave vessel speed control mode is temporarily canceled for the predetermined period of time is reliably achieved. Furthermore, it is not necessary to perform an operation to return to the in-wave vessel speed control mode, and thus the operational burden on the vessel user is reduced.

In such a case, the controller is preferably configured or programmed to return to the in-wave vessel speed control mode when the predetermined period of time has elapsed and without any operation being performed on the operator. Accordingly, when the operator is operated before the predetermined period of time has elapsed, the controller prioritizes an operation intended by the vessel user without returning to the in-wave vessel speed control mode.

In a marine propulsion system according to an example embodiment of the present invention, the operator preferably includes a vessel speed adjustment operator to receive an operation to adjust the vessel speed and an operation to cancel the in-wave vessel speed control mode, and the controller is preferably configured or programmed to temporarily cancel the in-wave vessel speed control mode for the predetermined period of time when the vessel speed adjustment operator is operated to cancel the in-wave vessel speed control mode. Generally, the vessel speed adjustment operator that receives the operation to adjust the vessel speed is located relatively close to the vessel user who is operating a marine vessel, and at a position at which the vessel user who is operating the marine vessel is able to operate the vessel speed adjustment operator practically without looking away from a direction in which the marine vessel is traveling. Therefore, with the structure described above, the operation to cancel the in-wave vessel speed control mode is performed on the vessel speed adjustment operator that receives the operation to adjust the vessel speed, and thus the in-wave vessel speed control mode is canceled without the vessel user taking his/her hand off the vessel speed adjustment operator located relatively close to the vessel user or looking away from the traveling direction while operating the marine vessel. Consequently, the in-wave vessel speed control mode is temporarily canceled for the predetermined period of time easily and smoothly.

In such a case, the vessel speed adjustment operator preferably includes a remote control lever assembly including a lever to receive a change in a rotational position of the lever as the operation to adjust the vessel speed, and the operation to cancel the in-wave vessel speed control mode, and the controller is preferably configured or programmed to temporarily cancel the in-wave vessel speed control mode for the predetermined period of time when the remote control lever assembly is operated to cancel the in-wave vessel speed control mode. Accordingly, the operation to cancel the in-wave vessel speed control mode is performed on a common remote control lever assembly as the vessel speed adjustment operator that receives the operation to adjust the vessel speed, and thus a structure in which the in-wave vessel speed control mode is canceled without the vessel user taking his/her hand off the remote control lever assembly located relatively close to the vessel user or looking away from the traveling direction while the vessel user is operating the marine vessel is easily achieved. Consequently, a structure in which the in-wave vessel speed control mode is temporarily canceled for the predetermined period of time easily and smoothly is easily achieved.

In a marine propulsion system including the controller configured or programmed to temporarily cancel the in-wave vessel speed control mode for the predetermined period of time when the remote control lever assembly is operated to cancel the in-wave vessel speed control mode, the controller is preferably configured or programmed to temporarily cancel the in-wave vessel speed control mode for the predetermined period of time when the rotational position of the lever of the remote control lever assembly is changed as the operation to cancel the in-wave vessel speed control mode. Accordingly, the operation to cancel the in-wave vessel speed control mode is also performed using the lever operated to adjust the vessel speed, and thus it is not necessary to provide, on the remote control lever assembly, a dedicated button or the like to cancel the in-wave vessel speed control mode. Consequently, the structure of the remote control lever assembly is simplified as compared with a case in which the operation to cancel the in-wave vessel speed control mode is other than changing the rotational position of the lever of the remote control lever assembly.

In such a case, the controller is preferably configured or programmed to, after temporarily canceling the in-wave vessel speed control mode, return to the in-wave vessel speed control mode with the vessel speed corresponding to the rotational position of the lever at a time at which the controller returns to the in-wave vessel speed control mode. Accordingly, as compared with a case in which the vessel speed conditions for returning to the in-wave vessel speed control mode do not include the rotational position of the lever, the vessel speed at the time at which the controller returns to the in-wave vessel speed control mode becomes clearer, and thus the complexity of the process of the controller to return to the in-wave vessel speed control mode is reduced or prevented.

In a marine propulsion system including the controller configured or programmed to temporarily cancel the in-wave vessel speed control mode for the predetermined period of time when the remote control lever assembly is operated to cancel the in-wave vessel speed control mode, the remote control lever assembly preferably includes a cancel button to receive the operation to cancel the in-wave vessel speed control mode, and the controller is preferably configured or programmed to temporarily cancel the in-wave vessel speed control mode for the predetermined period of time when the cancel button of the remote control lever assembly is operated to cancel the in-wave vessel speed control mode. Accordingly, the operation to cancel the in-wave vessel speed control mode is performed using the cancel button, which is provided exclusively to cancel the in-wave vessel speed control mode, separately from the lever operated to adjust the vessel speed, and thus the possibility that the vessel user accidentally performs an operation other than the operation to cancel the in-wave vessel speed control mode when performing the operation to cancel the in-wave vessel speed control mode is reduced or prevented.

In a marine propulsion system according to an example embodiment of the present invention, the operator preferably includes a steering wheel assembly including a wheel to receive a change in a rotational position of the wheel as an operation to adjust a steering angle of the propulsion device, and an operation to cancel the in-wave vessel speed control mode, and the controller is preferably configured or programmed to temporarily cancel the in-wave vessel speed control mode for the predetermined period of time when the steering wheel assembly is operated to cancel the in-wave vessel speed control mode. Generally, the steering wheel assembly that receives a change in the rotational position of the wheel as the operation to adjust the steering angle of the propulsion device is located relatively close to the vessel user who is operating the marine vessel, and at a position at which the vessel user who is operating the marine vessel is able to operate the steering wheel assembly practically without looking away from the direction in which the marine vessel is traveling. Therefore, with the structure described above, the operation to cancel the in-wave vessel speed control mode is performed on the steering wheel assembly that receives the operation to adjust the steering angle of the propulsion device, and thus the in-wave vessel speed control mode is canceled without the vessel user taking his/her hand off the steering wheel assembly located relatively close to the vessel user or looking away from the traveling direction while operating the marine vessel. Consequently, the in-wave vessel speed control mode is temporarily canceled for the predetermined period of time easily and smoothly.

In a marine propulsion system including the controller configured or programmed to return to the in-wave vessel speed control mode when the predetermined period of time has elapsed and without any operation being performed on the operator, the predetermined period of time is preset according to the vessel speed at a time at which the in-wave vessel speed control mode is temporarily canceled or information correlated to the vessel speed at the time at which the in-wave vessel speed control mode is temporarily canceled, and the controller is preferably configured or programmed to return to the in-wave vessel speed control mode when the predetermined period of time has elapsed and without any operation being performed on the operator. Accordingly, the predetermined period of time used to determine whether or not the controller returns to the in-wave vessel speed control mode is appropriately set according to the vessel speed at the time at which the in-wave vessel speed control mode is temporarily canceled or the information (the rotation speed of an engine) correlated to the vessel speed at the time at which the in-wave vessel speed control mode is temporarily canceled, and the controller performs a process to return to the in-wave vessel speed control mode.

In a marine propulsion system including the controller configured or programmed to return to the in-wave vessel speed control mode when the predetermined period of time has elapsed and without any operation being performed on the operator, the operator preferably includes a vessel speed adjustment operator to receive an operation to adjust the vessel speed and an operation to cancel the in-wave vessel speed control mode, the predetermined period of time is preset according to a state of the vessel speed adjustment operator at a time at which the in-wave vessel speed control mode is temporarily canceled or a change in the state of the vessel speed adjustment operator at the time at which the in-wave vessel speed control mode is temporarily canceled, and the controller is preferably configured or programmed to return to the in-wave vessel speed control mode when the predetermined period of time has elapsed and without any operation being performed on the vessel speed adjustment operator. Accordingly, the predetermined period of time used to determine whether or not the controller returns to the in-wave vessel speed control mode is appropriately set according to the state of the vessel speed adjustment operator at the time at which the in-wave vessel speed control mode is temporarily canceled or a change in the state of the vessel speed adjustment operator at the time at which the in-wave vessel speed control mode is temporarily canceled, and the controller performs a process to return to the in-wave vessel speed control mode.

In a marine propulsion system according to an example embodiment of the present invention, the operator preferably includes a touch panel on which a cancel button is displayed to receive an operation to cancel the in-wave vessel speed control mode, and the controller is preferably configured or programmed to temporarily cancel the in-wave vessel speed control mode for the predetermined period of time when the cancel button displayed on the touch panel is operated to cancel the in-wave vessel speed control mode. Accordingly, the operation to cancel the in-wave vessel speed control mode is performed on the cancel button displayed on the touch panel, and thus the vessel user performs the operation to cancel the in-wave vessel speed control mode while looking at the cancel button. Consequently, the in-wave vessel speed control mode is temporarily canceled for the predetermined period of time visually and easily.

In a marine propulsion system according to an example embodiment of the present invention, the operator preferably includes a switch panel including a plurality of physical switches that include a cancel button to receive an operation to cancel the in-wave vessel speed control mode, and the controller is preferably configured or programmed to temporarily cancel the in-wave vessel speed control mode for the predetermined period of time when the cancel button of the switch panel is operated to cancel the in-wave vessel speed control mode. Accordingly, the cancel button as a physical switch on the switch panel is operated to cancel the in-wave vessel speed control mode, and thus once the vessel user remembers the position of the cancel button, he/she performs the operation to cancel the in-wave vessel speed control mode without looking at the cancel button. Consequently, the in-wave vessel speed control mode is temporarily canceled for the predetermined period of time easily.

In a marine propulsion system according to an example embodiment of the present invention, the operator preferably includes a mode start button to receive an operation to start the in-wave vessel speed control mode, and the controller is preferably configured or programmed to start the in-wave vessel speed control mode when the mode start button is operated to start the in-wave vessel speed control mode, and temporarily cancel the in-wave vessel speed control mode for the predetermined period of time when the operator, other than the mode start button, is operated to cancel the in-wave vessel speed control mode. Accordingly, the operation to temporarily cancel the in-wave vessel speed control mode is performed using an operator other than the mode start button that receives the operation to start the in-wave vessel speed control mode, and thus the possibility that the vessel user accidentally performs the operation to start the in-wave vessel speed control mode when performing the operation to temporarily cancel the in-wave vessel speed control mode is reduced or prevented. In other words, the occurrence of a situation in which the vessel user has intended to temporarily cancel the in-wave vessel speed control mode but an operation has not been actually performed to temporarily cancel the in-wave vessel speed control mode is reduced or prevented.

In a marine propulsion system according to an example embodiment of the present invention, the controller is preferably configured or programmed to perform a notification control to notify the vessel user that the in-wave vessel speed control mode has been temporarily canceled when the in-wave vessel speed control mode has been temporarily canceled. Accordingly, when the in-wave vessel speed control mode has been temporarily canceled, the vessel user recognizes that the in-wave vessel speed control mode has been temporarily canceled.

A marine vessel according to an example embodiment of the present invention includes a propulsion device on a hull, a controller configured or programmed to control driving of the propulsion device to adjust a vessel speed and perform an in-wave vessel speed control to adjust the vessel speed based on information regarding upward-downward movement of the hull, and an operator to receive an operation from a vessel user. The controller is configured or programmed to temporarily cancel an in-wave vessel speed control mode, in which the in-wave vessel speed control is performed, for a predetermined period of time when the operator is operated to cancel the in-wave vessel speed control mode.

In a marine vessel according to an example embodiment of the present invention, the controller is configured or programmed to temporarily cancel the in-wave vessel speed control mode, in which the in-wave vessel speed control is performed, for the predetermined period of time when the operator is operated to cancel the in-wave vessel speed control mode. Accordingly, similarly to the marine propulsion system according to example embodiments of the present invention described above, when the vessel user operates the operator to cancel the in-wave vessel speed control mode, the in-wave vessel speed control mode is temporarily canceled for the predetermined period of time. Consequently, while a control is performed to adjust the vessel speed based on the information regarding upward-downward movement of the hull when waves are occurring, the hull is temporarily operated as intended by the vessel user regardless of the upward-downward movement of the hull.

In a marine vessel according to an example embodiment of the present invention, the controller is preferably configured or programmed to return to the in-wave vessel speed control mode when the predetermined period of time has elapsed. Accordingly, similarly to the marine propulsion system according to example embodiments of the present invention described above, a structure in which the in-wave vessel speed control mode is temporarily canceled for the predetermined period of time is reliably achieved. Furthermore, it is not necessary to perform an operation to return to the in-wave vessel speed control mode, and thus the operational burden on the vessel user is reduced.

In such a case, the controller is preferably configured or programmed to return to the in-wave vessel speed control mode when the predetermined period of time has elapsed and without any operation being performed on the operator. Accordingly, similarly to the marine propulsion system according to example embodiments of the present invention described above, when the operator is operated before the predetermined period of time has elapsed, the controller prioritizes an operation intended by the vessel user without returning to the in-wave vessel speed control mode.

In a marine vessel according to an example embodiment of the present invention, the operator preferably includes a vessel speed adjustment operator to receive an operation to adjust the vessel speed and an operation to cancel the in-wave vessel speed control mode, and the controller is preferably configured or programmed to temporarily cancel the in-wave vessel speed control mode for the predetermined period of time when the vessel speed adjustment operator is operated to cancel the in-wave vessel speed control mode. Accordingly, similarly to the marine propulsion system according to example embodiments of the present invention described above, the in-wave vessel speed control mode is temporarily canceled for the predetermined period of time easily and smoothly.

In such a case, the vessel speed adjustment operator preferably includes a remote control lever assembly including a lever to receive a change in a rotational position of the lever as the operation to adjust the vessel speed, and the operation to cancel the in-wave vessel speed control mode, and the controller is preferably configured or programmed to temporarily cancel the in-wave vessel speed control mode for the predetermined period of time when the remote control lever assembly is operated to cancel the in-wave vessel speed control mode. Accordingly, similarly to the marine propulsion system according to example embodiments of the present invention described above, a structure in which the in-wave vessel speed control mode is temporarily canceled for the predetermined period of time easily and smoothly is easily achieved.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Example embodiments of the present invention are hereinafter described with reference to the drawings.

A marine propulsion system 100 and a marine vessel 110 according to example embodiments of the present invention are now described with reference to FIGS. 1 to 10.

Figure 1:
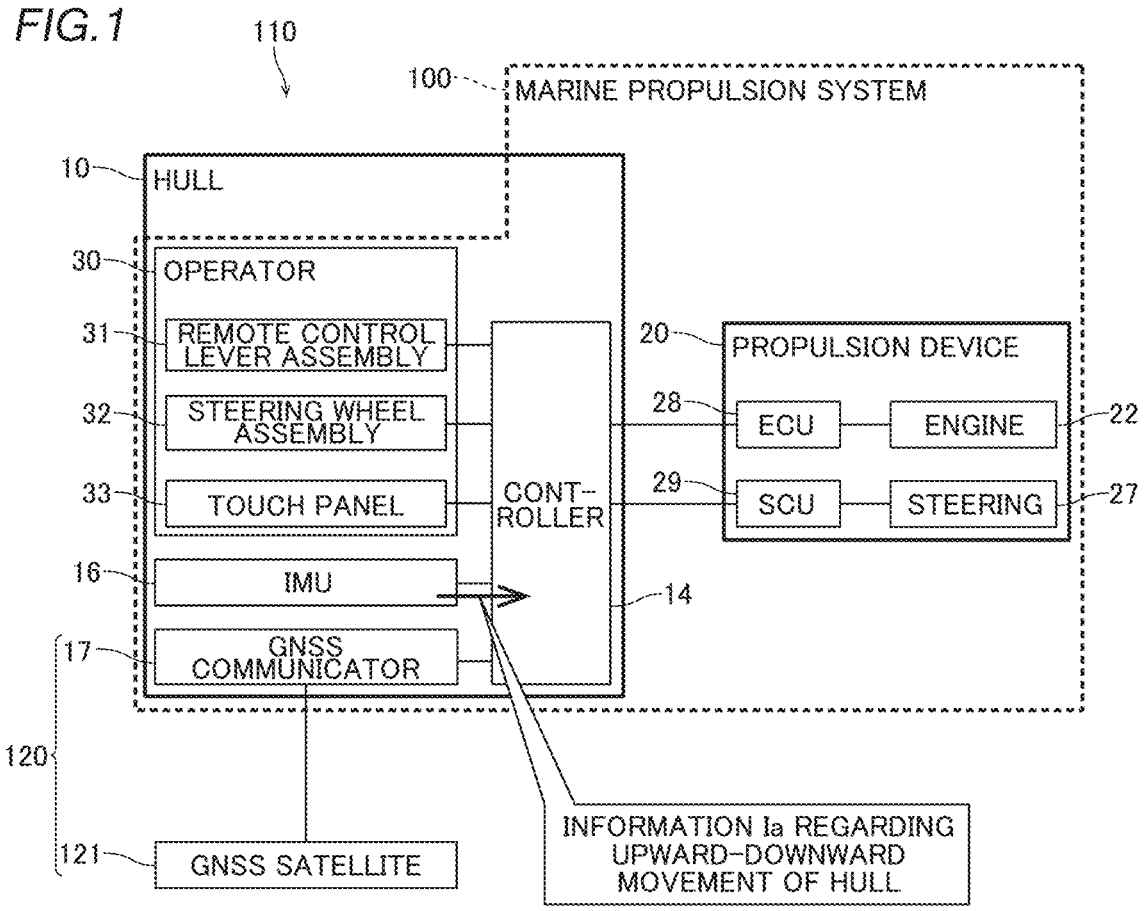
FIG. 1 is a block diagram of a marine propulsion system according to an example embodiment of the present invention.

As shown in FIG. 1, the marine propulsion system 100 is provided on or in the marine vessel 110. The marine propulsion system 100 propels the marine vessel 110. The marine vessel 110 may be a relatively small marine vessel used for sightseeing or fishing, for example.

Figure 2:
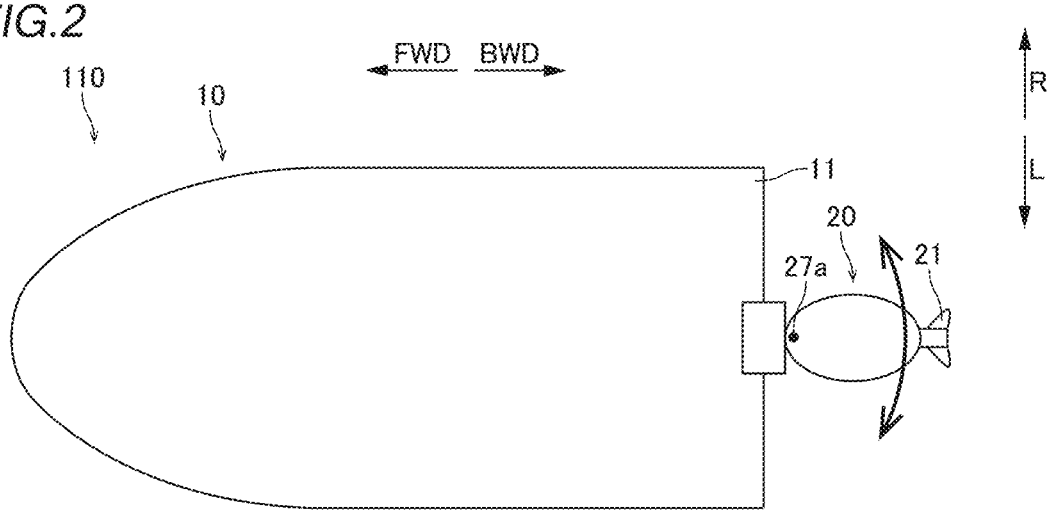
FIG. 2 is a schematic view of a marine vessel according to an example embodiment of the present invention.

The marine propulsion system 100 (marine vessel 110) includes a hull 10 and a propulsion device 20. As shown in FIG. 2, the propulsion device 20 is provided on the hull 10. The propulsion device 20 is attached to a stern 11 of the hull 10. That is, the propulsion device 20 is an outboard motor.

As shown in FIG. 1, the hull 10 includes an operator 30, a controller 14, an inertial measurement unit (IMU) 16, and a global navigation satellite system (GNSS) communicator 17.

The operator 30 receives operations from a vessel user to operate (maneuver) the marine vessel 110. The operator 30 includes a remote control lever assembly 31, a steering wheel assembly 32, and a touch panel 33. The remote control lever assembly 31 is an example of a "vessel speed adjustment operator".

Figure 3:
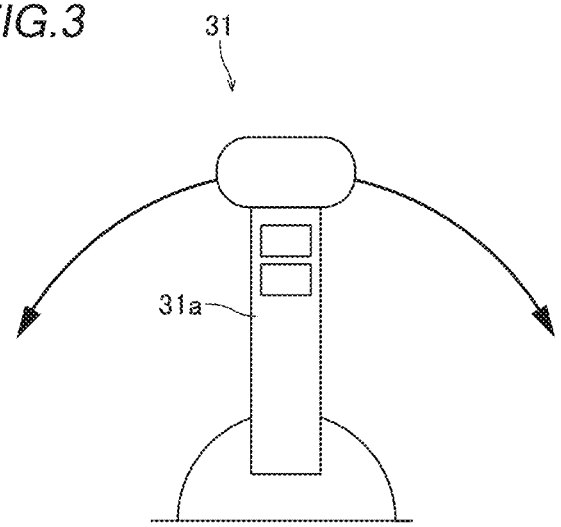
FIG. 3 is a schematic view showing a remote control lever assembly of a marine propulsion system according to an example embodiment of the present invention.
Figure 4:
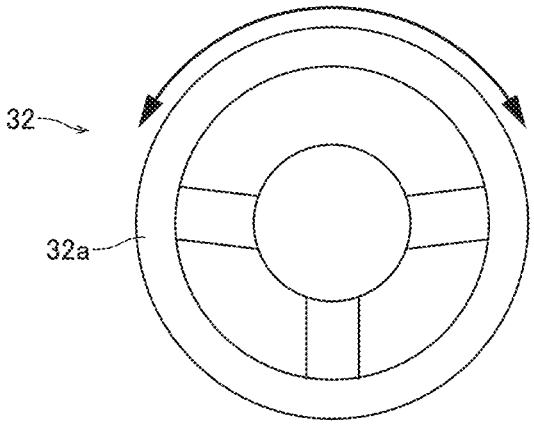
FIG. 4 is a schematic view showing a steering wheel assembly of a marine propulsion system according to an example embodiment of the present invention.
Figure 7:
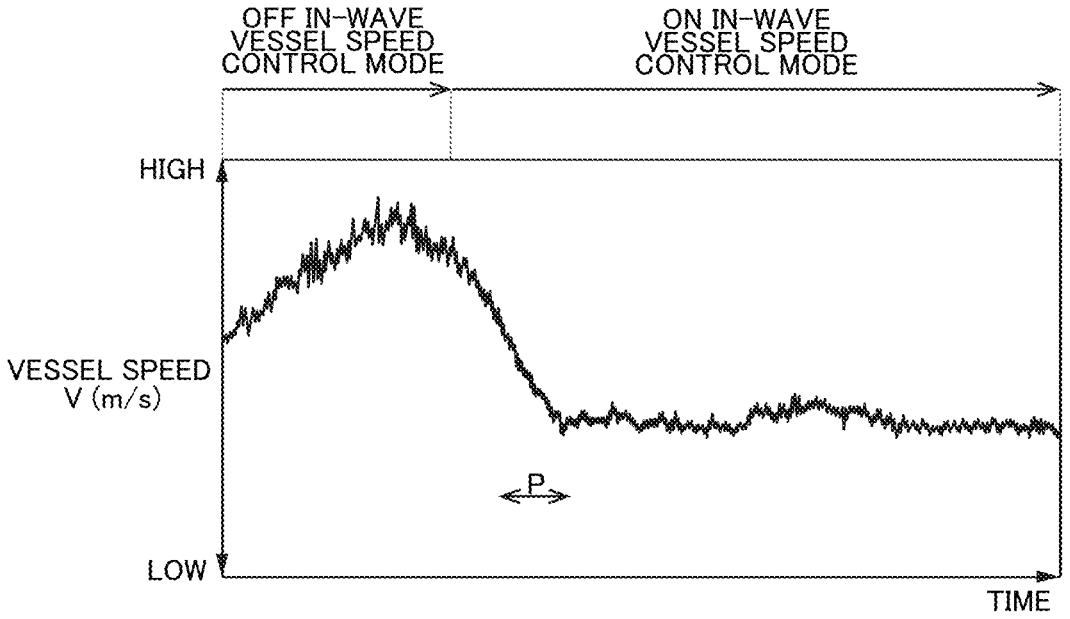
FIG. 7 is a diagram showing changes in a vessel speed by an in-wave vessel speed control in a marine propulsion system according to an example embodiment of the present invention.

As shown in FIG. 3, the remote control lever assembly 31 receives an operation to adjust a vessel speed V (see FIG. 7). Specifically, the remote control lever assembly 31 includes a lever 31*a*, and receives a change in the rotational position of the lever 31*a* as an operation to adjust the vessel speed V. As shown in FIG. 4, the steering wheel assembly 32 includes a wheel 32*a*, and receives a change in the rotational position of the wheel 32*a* as an operation to adjust the steering angle of the propulsion device 20 (see FIG. 1).

Figure 5:
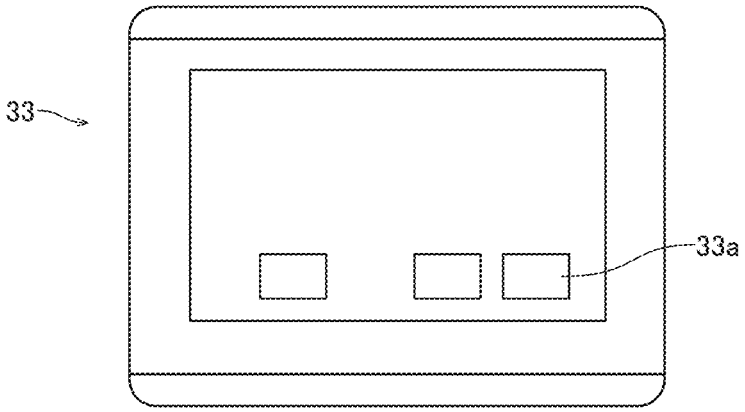
FIG. 5 is a schematic view showing a touch panel of a marine propulsion system according to an example embodiment of the present invention.

As shown in FIG. 5, the touch panel 33 displays buttons to receive operations of the vessel user and information about the marine vessel 110 (see FIG. 1). The information about the marine vessel 110 includes the vessel speed V (actual vessel speed) (see FIG. 7), the rotation speed of an engine 22 (see FIG. 1) of the propulsion device 20 (see FIG. 1), the shift state of the propulsion device 20, a navigation mode of the marine vessel 110, etc., for example. The navigation mode of the marine vessel 110 includes an in-wave vessel speed control mode described below.

As shown in FIG. 1, the controller 14 controls an engine control unit (ECU) 28 and a steering control unit (SCU) 29 of the propulsion device 20 based on operations performed on the operator 30. That is, the controller 14 controls driving of the propulsion device 20 to adjust the vessel speed V (see FIG. 7). The controller 14 is a computer that includes an arithmetic unit such as a central processing unit (CPU), storages such as a read-only memory (ROM) and a random access memory (RAM), etc.

The IMU 16 includes a gyroscope, an accelerometer, etc. The IMU 16 detects the acceleration of the hull 10 in an upward-downward direction, for example. That is, the IMU 16 detects information Ia regarding upward-downward movement of the hull 10. The controller 14 acquires the information Ia regarding upward-downward movement of the hull 10 detected by the IMU 16.

A global navigation satellite system 120 includes the GNSS communicator 17 and a GNSS satellite 121. The GNSS communicator 17 communicates with the GNSS satellite 121. The controller 14 acquires position information about the hull 10, the vessel speed V (actual vessel speed) (see FIG. 7), etc. based on information communicated with the GNSS satellite 121 via the GNSS communicator 17.

Figure 6:
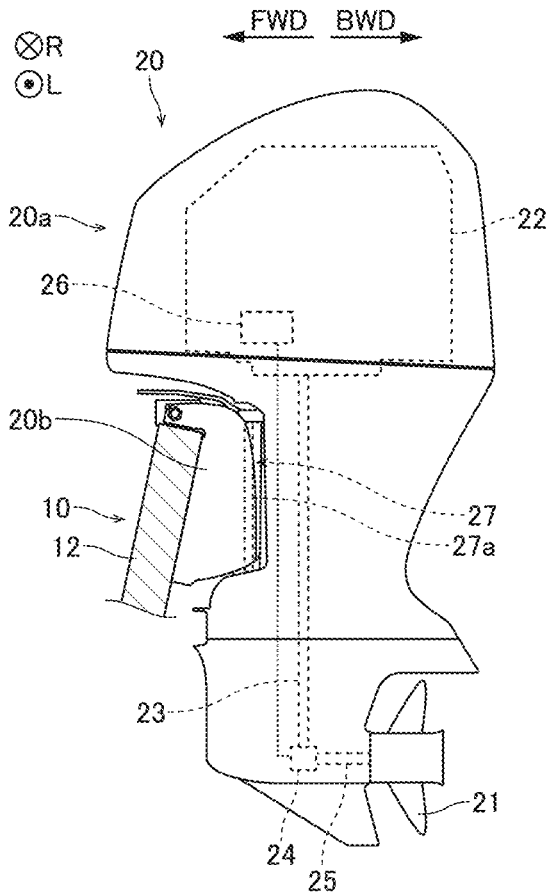
FIG. 6 is a side view showing a propulsion device of a marine propulsion system according to an example embodiment of the present invention.

As shown in FIG. 6, the propulsion device 20 includes a propulsion device main body 20*a* and a bracket 20*b*. The propulsion device main body 20*a* is attached to a transom 12 at the stern 11 (see FIG. 1) of the hull 10 via the bracket 20*b*.

The propulsion device 20 includes the engine 22 to drive a propeller 21 to generate a thrust. That is, the propulsion device 20 is an engine outboard motor including the engine 22 to drive the propeller 21. Specifically, the propulsion device main body 20*a* includes the engine 22, a drive shaft 23, a gearing 24, a propeller shaft 25, and the propeller 21. The engine 22 may be an internal combustion engine that generates a driving force. The driving force of the engine 22 is transmitted to the propeller 21 via the drive shaft 23, the gearing 24, and the propeller shaft 25. The propeller 21 generates a propulsive force to propel the hull 10 by rotating in the water by the driving force transmitted from the engine 22.

The propulsion device main body 20*a* includes a shift actuator 26 to switch the shift state of the propulsion device 20. The shift actuator 26 switches the shift state of the propulsion device 20 between a forward movement state, a reverse movement state, and a neutral state by switching the meshing of the gearing 24. In the forward movement state, a driving force is transmitted from the engine 22 to the propeller 21 to generate a forward thrust from the propeller 21. In the reverse movement state, a driving force is transmitted from the engine 22 to the propeller 21 to generate a reverse thrust from the propeller 21. In the neutral state, a driving force is not transmitted from the engine 22 to the propeller 21 to not generate a thrust by the propeller 21.

The propulsion device 20 includes a steering 27 to change the direction of the propulsive force of the propeller 21 so as to change the traveling direction of the hull 10. Specifically, the steering 27 is provided on the bracket 20*b*. The steering 27 includes a steering shaft 27*a* that extends in the upward-downward direction. The propulsion device main body 20*a* is rotated in a right-left direction by the steering 27 about the steering shaft 27*a* with respect to the bracket 20*b*. When the propulsion device main body 20*a* rotates in the right-left direction about the steering shaft 27*a*, the orientation of the propeller 21 also rotates in the right-left direction. Thus, the direction of the propulsive force of the propeller 21 is changed. That is, the propulsion device 20 is steered.

As shown in FIG. 1, the propulsion device 20 includes the ECU 28 and the SCU 29. The ECU 28 controls driving of the engine 22 and driving of the shift actuator 26 based on a control by the controller 14. That is, the controller 14 controls the vessel speed V (see FIG. 7) by controlling driving of the engine 22 via the ECU 28 to change the propulsive force of the propeller 21. The SCU 29 controls driving of the steering 27 based on the control by the controller 14. Each of the ECU 28 and the SCU 29 is a computer that includes an arithmetic unit such as a CPU, storages such as a ROM and a RAM, etc.

As shown in FIG. 7, the marine propulsion system 100 (see FIG. 1) (marine vessel 110 (see FIG. 1)) adjusts the vessel speed V such that an impact on the hull 10 caused by the hull 10 (see FIG. 1) riding over a wave is within a preset range when waves are occurring. Specifically, the controller 14 (see FIG. 1) performs an in-wave vessel speed control to adjust the vessel speed V based on the information Ia (see FIG. 1) regarding upward-downward movement of the hull 10 when waves are occurring. The information Ia regarding upward-downward movement of the hull 10 refers to the acceleration of the hull 10 in the upward-downward direction, for example.

Figure 8:
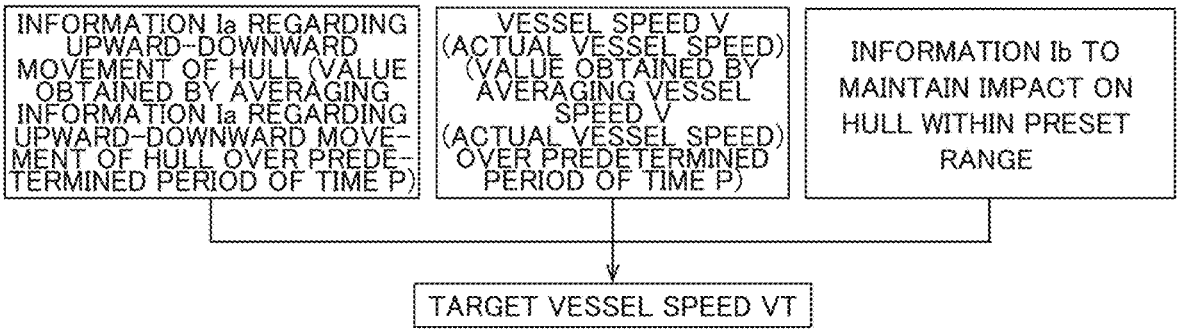
FIG. 8 is a diagram illustrating vessel speed adjustment by an in-wave vessel speed control in a marine propulsion system according to an example embodiment of the present invention.

Specifically, as shown in FIG. 8, the controller 14 (see FIG. 1) first acquires the information Ia regarding upward-downward movement of the hull 10 from the IMU 16 (see FIG. 1). The controller 14 then calculates a target vessel speed VT, which is the target value of the vessel speed V, based on the acquired information Ia regarding upward-downward movement of the hull 10, the vessel speed V (actual vessel speed) acquired by the global navigation satellite system 120 (see FIG. 1), and information Ib to maintain the impact on the hull 10 within the preset range. Then, the controller 14 performs a feedback control to adjust the vessel speed V based on a difference between the calculated target vessel speed VT and the acquired vessel speed V (actual vessel speed).

The controller 14 (see FIG. 1) calculates the target vessel speed VT based on a value obtained by averaging the information Ia regarding upward-downward movement of the hull 10 over a predetermined period of time P. Specifically, the controller 14 calculates the target vessel speed VT such that the impact on the hull 10 caused by the hull 10 riding over a wave is within the preset range when waves are occurring, based on the value obtained by averaging the acquired information Ia regarding upward-downward movement of the hull 10 over the predetermined period of time P, a value obtained by averaging the vessel speed V (actual vessel speed) over the predetermined period of time P, and the information Ib to maintain the impact on the hull 10 within the preset range.

As shown in FIG. 7, when the navigation mode of the marine vessel 110 (see FIG. 1) is an in-wave vessel speed control mode in which an in-wave vessel speed control is performed, the controller 14 (see FIG. 1) controls the in-wave vessel speed control. In FIG. 7, a state in which the navigation mode of the marine vessel 110 is the in-wave vessel speed control mode and a state in which the navigation mode is not the in-wave vessel speed control mode are defined as an ON in-wave vessel speed control mode and an OFF in-wave vessel speed control mode, respectively.

Figure 9:
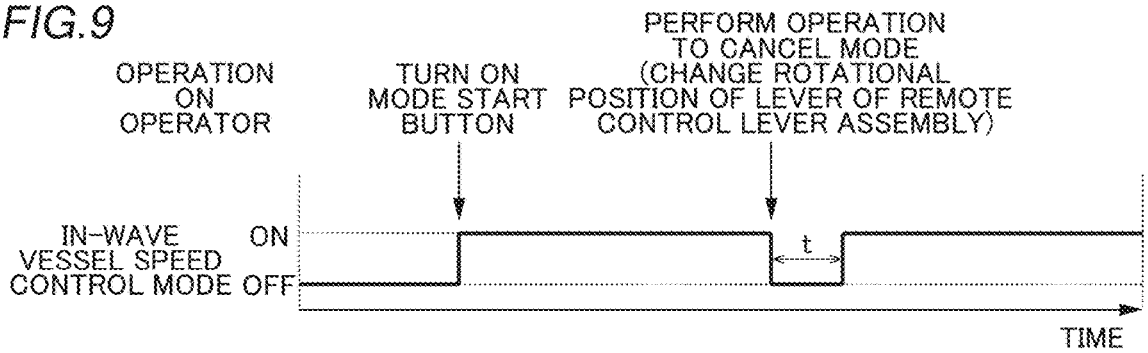
FIG. 9 is a diagram illustrating temporary cancellation of an in-wave vessel speed control in a marine propulsion system according to an example embodiment of the present invention.

As shown in FIG. 5, the operator 30 (see FIG. 1) includes a mode start button 33*a* to receive an operation to start the in-wave vessel speed control mode. Specifically, the touch panel 33 displays the mode start button 33*a* that receives an operation to start the in-wave vessel speed control mode. As shown in FIG. 9, the controller 14 (see FIG. 1) starts the in-wave vessel speed control mode when the mode start button 33*a* (see FIG. 5) is operated to start the in-wave vessel speed control mode. Specifically, the controller 14 starts the in-wave vessel speed control mode when the mode start button 33*a* displayed on the touch panel 33 (see FIG. 5) is pressed. The controller 14 terminates the in-wave vessel speed control mode when the mode start button 33*a* is operated in the in-wave vessel speed control mode.

As shown in FIG. 9, the controller 14 (see FIG. 1) temporarily cancels the in-wave vessel speed control mode, in which the in-wave vessel speed control is performed, for a predetermined period of time t when the operator 30 is operated to cancel the in-wave vessel speed control mode. Specifically, the remote control lever assembly 31 receives an operation to cancel the in-wave vessel speed control mode. The operation to cancel the in-wave vessel speed control mode is to change the rotational position of the lever 31*a* of the remote control lever assembly 31. Then, the controller 14 temporarily cancels the in-wave vessel speed control mode for the predetermined period of time t when the remote control lever assembly 31, (i.e., an operator other than the mode start button 33*a* (see FIG. 5)), is operated to cancel the in-wave vessel speed control mode.

The controller 14 (see FIG. 1) returns to the in-wave vessel speed control mode when the predetermined period of time t, preset according to the vessel speed V (see FIG. 7) at the time at which the in-wave vessel speed control mode is temporarily canceled or the rotation speed (information correlated to the vessel speed V) of the engine 22 (see FIG. 1) at the time at which the in-wave vessel speed control mode is temporarily canceled, has elapsed without any operation being performed on the operator 30 since the in-wave vessel speed control mode was temporarily canceled. As the vessel speed V increases, the impact on the hull 10 (see FIG. 1) increases, and thus when the vessel speed V is relatively high, it is desired to return to the in-wave vessel speed control mode relatively quickly after the in-wave vessel speed control mode is temporarily canceled. Therefore, for example, the predetermined period of time t is set to be relatively short when the vessel speed V (the rotation speed of the engine 22) at the time at which the in-wave vessel speed control mode is temporarily canceled is relatively high, and is set to be relatively long when the vessel speed V (the rotation speed of the engine 22) at the time at which the in-wave vessel speed control mode is temporarily canceled is relatively low.

The controller 14 (see FIG. 1) returns to the in-wave vessel speed control mode when the predetermined period of time t, preset according to the state of the remote control lever assembly 31 at the time at which the in-wave vessel speed control mode is temporarily canceled or a change in the state of the remote control lever assembly 31 at the time at which the in-wave vessel speed control mode is temporarily canceled, has elapsed without any operation being performed on the operator 30 since the in-wave vessel speed control mode was temporarily canceled. Specifically, the controller 14 returns to the in-wave vessel speed control mode when the predetermined period of time t, preset according to the rotational position of the lever 31*a* of the remote control lever assembly 31 at the time at which the in-wave vessel speed control mode is temporarily canceled or the amount of change in the rotational position of the lever 31*a* of the remote control lever assembly 31 at the time at which the in-wave vessel speed control mode is temporarily canceled, has elapsed without any operation being performed on the operator 30 since the in-wave vessel speed control mode was temporarily canceled. As described above, as the vessel speed V (see FIG. 7) increases, the impact on the hull 10 increases, and thus when the vessel speed V is relatively high, it is desired to return to the in-wave vessel speed control mode relatively quickly after the in-wave vessel speed control mode is temporarily canceled. Therefore, for example, the predetermined period of time t is set to be relatively short when the rotational position of the lever 31*a* of the remote control lever assembly 31 at the time at which the in-wave vessel speed control mode is temporarily canceled is relatively spaced away from a neutral position (when the target vessel speed VT (see FIG. 8) (and the vessel speed V) is high), and is set to be relatively long when the rotational position of the lever 31*a* of the remote control lever assembly 31 at the time at which the in-wave vessel speed control mode is temporarily canceled is relatively close to the neutral position (when the target vessel speed VT (and the vessel speed V) is low). Furthermore, as described below, after temporarily canceling the in-wave vessel speed control mode, the controller 14 returns to the in-wave vessel speed control mode with the vessel speed V corresponding to the rotational position of the lever 31*a* at the time at which the controller 14 returns to the in-wave vessel speed control mode, and thus it is necessary to increase a period of time to change (increase/decrease) the vessel speed V as the amount of change in the rotational position of the lever 31*a* of the remote control lever assembly 31 increases. Therefore, for example, the predetermined period of time t is set to be relatively long when the amount of change in the rotational position of the lever 31*a* of the remote control lever assembly 31 at the time at which the in-wave vessel speed control mode is temporarily canceled is relatively large, and is set to be relatively short when the amount of change in the rotational position of the lever 31*a* of the remote control lever assembly 31 at the time at which the in-wave vessel speed control mode is temporarily canceled is relatively small.

After temporarily canceling the in-wave vessel speed control mode, the controller 14 (see FIG. 1) returns to the in-wave vessel speed control mode with the vessel speed V (see FIG. 7) corresponding to the rotational position of the lever 31*a* at the time at which the controller 14 returns to the in-wave vessel speed control mode. That is, when the controller 14 returns to the in-wave vessel speed control mode, the normal state is immediately established in which the vessel speed V is adjusted according to the rotational position of the lever 31*a*.

Figure 10:
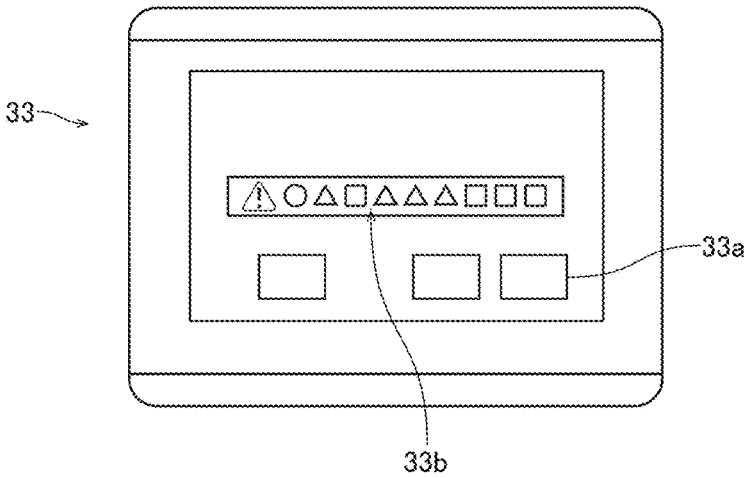
FIG. 10 is a diagram showing a state in which a vessel user is notified of temporary cancellation of an in-wave vessel speed control in a marine propulsion system according to an example embodiment of the present invention.

When temporarily canceling the in-wave vessel speed control mode, the controller 14 (see FIG. 1) performs a notification control to notify the vessel user that the in-wave vessel speed control mode has been temporarily canceled. For example, as shown in FIG. 10, when temporarily canceling the in-wave vessel speed control mode, the controller 14 (see FIG. 1) performs, as the notification control, a control to display a message 33*b* on the touch panel 33 indicating that the in-wave vessel speed control mode has been temporarily canceled. The controller 14 may perform, as the notification control, a control to display a mark on the touch panel 33 indicating that the in-wave vessel speed control mode has been temporarily canceled, a control to output a sound indicating that the in-wave vessel speed control mode has been temporarily canceled, a control to light or blink a lamp indicating that the in-wave vessel speed control mode has been temporarily canceled, etc.

According to the various example embodiments of the present invention described above, the following advantageous effects are achieved.

According to an example embodiment of the present invention, the controller 14 is configured or programmed to temporarily cancel the in-wave vessel speed control mode, in which the in-wave vessel speed control is performed, for the predetermined period of time t when the operator 30 is operated to cancel the in-wave vessel speed control mode. Accordingly, when the vessel user operates the operator 30 to cancel the in-wave vessel speed control mode, the in-wave vessel speed control mode is temporarily canceled for the predetermined period of time t. Consequently, while a control is performed to adjust the vessel speed V based on the information Ia regarding upward-downward movement of the hull 10 when waves are occurring, the hull 10 is temporarily operated as intended by the vessel user regardless of the upward-downward movement of the hull 10.

According to an example embodiment of the present invention, the controller 14 is configured or programmed to return to the in-wave vessel speed control mode when the predetermined period of time t has elapsed since the in-wave vessel speed control mode was temporarily canceled. Accordingly, when the predetermined period of time t has elapsed since the in-wave vessel speed control mode was canceled, the controller 14 automatically returns to the in-wave vessel speed control mode, and thus a structure in which the in-wave vessel speed control mode is temporarily canceled for the predetermined period of time t is reliably achieved. Furthermore, it is not necessary to perform an operation to return to the in-wave vessel speed control mode, and thus the operational burden on the vessel user is reduced.

According to an example embodiment of the present invention, the controller 14 is configured or programmed to return to the in-wave vessel speed control mode when the predetermined period of time t has elapsed without any operation being performed on the operator 30 since the in-wave vessel speed control mode was temporarily canceled. Accordingly, when the operator 30 is operated before the predetermined period of time t has elapsed since the in-wave vessel speed control mode was temporarily canceled, the controller 14 prioritizes an operation intended by the vessel user without returning to the in-wave vessel speed control mode.

According to an example embodiment of the present invention, the operator 30 includes the vessel speed adjustment operator to receive an operation to adjust the vessel speed V and an operation to cancel the in-wave vessel speed control mode, and the controller 14 is configured or programmed to temporarily cancel the in-wave vessel speed control mode for the predetermined period of time t when the remote control lever assembly 31 (vessel speed adjustment operator) is operated to cancel the in-wave vessel speed control mode. Generally, the remote control lever assembly 31 that receives the operation to adjust the vessel speed V is located relatively close to the vessel user who is operating the marine vessel, and at a position at which the vessel user who is operating the marine vessel is able to operate the remote control lever assembly 31 practically without looking away from a direction in which the marine vessel 110 is traveling. Therefore, the operation to cancel the in-wave vessel speed control mode is performed on the remote control lever assembly 31 that receives the operation to adjust the vessel speed V, and thus the in-wave vessel speed control mode is canceled without the vessel user taking his/her hand off the remote control lever assembly 31 located relatively close to the vessel user or looking away from the traveling direction while operating the marine vessel 110. Consequently, the in-wave vessel speed control mode is temporarily canceled for the predetermined period of time t easily and smoothly.

According to an example embodiment of the present invention, the vessel speed adjustment operator includes the remote control lever assembly 31 including the lever 31*a* to receive a change in the rotational position of the lever 31*a* as an operation to adjust the vessel speed V, and an operation to cancel the in-wave vessel speed control mode. Furthermore, the controller 14 is configured or programmed to temporarily cancel the in-wave vessel speed control mode for the predetermined period of time t when the remote control lever assembly 31 is operated to cancel the in-wave vessel speed control mode. Accordingly, the operation to cancel the in-wave vessel speed control mode is performed on a common remote control lever assembly 31 as the vessel speed adjustment operator that receives the operation to adjust the vessel speed V, and thus a structure in which the in-wave vessel speed control mode is canceled without the vessel user taking his/her hand off the remote control lever assembly 31 located relatively close to the vessel user or looking away from the traveling direction while the vessel user is operating the marine vessel 110 is easily achieved. Consequently, a structure in which the in-wave vessel speed control mode is temporarily canceled for the predetermined period of time t easily and smoothly is easily achieved.

According to an example embodiment of the present invention, the controller 14 is configured or programmed to temporarily cancel the in-wave vessel speed control mode for the predetermined period of time t when the rotational position of the lever 31*a* of the remote control lever assembly 31 is changed as an operation to cancel the in-wave vessel speed control mode. Accordingly, the operation to cancel the in-wave vessel speed control mode is also performed using the lever 31*a* operated to adjust the vessel speed V, and thus it is not necessary to provide, on the remote control lever assembly 31, a dedicated button or the like to cancel the in-wave vessel speed control mode. Consequently, the structure of the remote control lever assembly 31 is simplified as compared with a case in which the operation to cancel the in-wave vessel speed control mode is other than changing the rotational position of the lever 31*a* of the remote control lever assembly 31.

According to an example embodiment of the present invention, the controller 14 is configured or programmed to, after temporarily canceling the in-wave vessel speed control mode, return to the in-wave vessel speed control mode with the vessel speed V corresponding to the rotational position of the lever 31*a* at the time at which the controller 14 returns to the in-wave vessel speed control mode. Accordingly, as compared with a case in which the vessel speed V conditions for returning to the in-wave vessel speed control mode do not include the rotational position of the lever 31*a*, the vessel speed V at the time at which the controller 14 returns to the in-wave vessel speed control mode becomes clearer, and thus the complexity of the process of the controller 14 to return to the in-wave vessel speed control mode is reduced or prevented.

According to an example embodiment of the present invention, the controller 14 is configured or programmed to return to the in-wave vessel speed control mode when the predetermined period of time t, preset according to the vessel speed V at the time at which the in-wave vessel speed control mode is temporarily canceled or the information correlated to the vessel speed V at the time at which the in-wave vessel speed control mode is temporarily canceled, has elapsed without any operation being performed on the operator 30 since the in-wave vessel speed control mode was temporarily canceled. Accordingly, the predetermined period of time t used to determine whether or not the controller 14 returns to the in-wave vessel speed control mode is appropriately set according to the vessel speed V at the time at which the in-wave vessel speed control mode is temporarily canceled or the information (the rotation speed of the engine 22) correlated to the vessel speed V at the time at which the in-wave vessel speed control mode is temporarily canceled, and the controller 14 performs a process to return to the in-wave vessel speed control mode.

According to an example embodiment of the present invention, the operator 30 includes the remote control lever assembly 31 (vessel speed adjustment operator) to receive an operation to adjust the vessel speed V and an operation to cancel the in-wave vessel speed control mode. Furthermore, the controller 14 is configured or programmed to return to the in-wave vessel speed control mode when the predetermined period of time t, preset according to the state of the remote control lever assembly 31 at the time at which the in-wave vessel speed control mode is temporarily canceled or a change in the state of the remote control lever assembly 31 at the time at which the in-wave vessel speed control mode is temporarily canceled, has elapsed without any operation being performed on the operator 30 since the in-wave vessel speed control mode was temporarily canceled. Accordingly, the predetermined period of time t used to determine whether or not the controller 14 returns to the in-wave vessel speed control mode is appropriately set according to the state of the remote control lever assembly 31 at the time at which the in-wave vessel speed control mode is temporarily canceled or a change in the state of the remote control lever assembly 31 at the time at which the in-wave vessel speed control mode is temporarily canceled, and the controller 14 performs a process to return to the in-wave vessel speed control mode.

According to an example embodiment of the present invention, the operator 30 includes the mode start button 33*a* to receive an operation to start the in-wave vessel speed control mode. Furthermore, the controller 14 is configured or programmed to start the in-wave vessel speed control mode when the mode start button 33*a* is operated to start the in-wave vessel speed control mode, and to temporarily cancel the in-wave vessel speed control mode for the predetermined period of time t when an operator, other than the mode start button 33*a*, is operated to cancel the in-wave vessel speed control mode. Accordingly, the operation to temporarily cancel the in-wave vessel speed control mode is performed using an operator other than the mode start button 33*a* that receives the operation to start the in-wave vessel speed control mode, and thus the possibility that the vessel user accidentally performs the operation to start the in-wave vessel speed control mode when performing the operation to temporarily cancel the in-wave vessel speed control mode is reduced or prevented. In other words, the occurrence of a situation in which the vessel user has intended to temporarily cancel the in-wave vessel speed control mode but an operation has not been actually performed to temporarily cancel the in-wave vessel speed control mode is reduced or prevented.

According to an example embodiment of the present invention, the controller 14 is configured or programmed to perform a notification control to notify the vessel user that the in-wave vessel speed control mode has been temporarily canceled when the in-wave vessel speed control mode has been temporarily canceled. Accordingly, when the in-wave vessel speed control mode has been temporarily canceled, the vessel user recognizes that the in-wave vessel speed control mode has been temporarily canceled.

The example embodiments of the present invention described above are illustrative in all points and not restrictive. The extent of the present invention is not defined by the above description of the example embodiments but by the scope of the claims, and all modifications within the meaning and range equivalent to the scope of the claims are further included.

For example, while the controller 14 preferably performs a notification control to notify the vessel user that the in-wave vessel speed control mode has been temporarily canceled when the in-wave vessel speed control mode has been temporarily canceled in example embodiments described above, the present invention is not restricted to this. In an example embodiment of the present invention, the controller may not perform a notification control to notify the vessel user that the in-wave vessel speed control mode has been temporarily canceled when the in-wave vessel speed control mode has been temporarily canceled.

While the controller 14 preferably temporarily cancels the in-wave vessel speed control mode for the predetermined period of time t when an operator different from the mode start button 33*a* is operated to cancel the in-wave vessel speed control mode in example embodiments described above, the present invention is not restricted to this. In an example embodiment of the present invention, the controller may alternatively temporarily cancel the in-wave vessel speed control mode for the predetermined period of time when the mode start button is operated to cancel the in-wave vessel speed control mode.

While the controller 14 preferably returns to the in-wave vessel speed control mode when the predetermined period of time t, preset according to the state of the remote control lever assembly 31 (vessel speed adjustment operator) at the time at which the in-wave vessel speed control mode is temporarily canceled or a change in the state of the remote control lever assembly 31 at the time at which the in-wave vessel speed control mode is temporarily canceled, has elapsed without any operation being performed on the operator 30 since the in-wave vessel speed control mode was temporarily canceled in example embodiments described above, the present invention is not restricted to this. In an example embodiment of the present invention, the controller may alternatively return to the in-wave vessel speed control mode when a predetermined period of time preset regardless of the state of the vessel speed adjustment operator at the time at which the in-wave vessel speed control mode is temporarily canceled and a change in the state of the vessel speed adjustment operator at the time at which the in-wave vessel speed control mode is temporarily canceled has elapsed without any operation being performed on the operator since the in-wave vessel speed control mode was temporarily canceled.

While the controller 14 preferably returns to the in-wave vessel speed control mode when the predetermined period of time t, preset according to the vessel speed V at the time at which the in-wave vessel speed control mode is temporarily canceled or the information correlated to the vessel speed V at the time at which the in-wave vessel speed control mode is temporarily canceled, has elapsed without any operation being performed on the operator 30 since the in-wave vessel speed control mode was temporarily canceled in example embodiments described above, the present invention is not restricted to this. In an example embodiment of the present invention, the controller may alternatively return to the in-wave vessel speed control mode when a predetermined period of time preset regardless of the vessel speed at the time at which the in-wave vessel speed control mode is temporarily canceled and the information correlated to the vessel speed at the time at which the in-wave vessel speed control mode is temporarily canceled has elapsed without any operation being performed on the operator since the in-wave vessel speed control mode was temporarily canceled.

While the controller 14 preferably, after temporarily canceling the in-wave vessel speed control mode, returns to the in-wave vessel speed control mode with the vessel speed V corresponding to the rotational position of the lever 31*a* at the time at which the controller 14 returns to the in-wave vessel speed control mode in example embodiments described above, the present invention is not restricted to this. In an example embodiment of the present invention, the controller may alternatively, after temporarily canceling the in-wave vessel speed control mode, return to the in-wave vessel speed control mode at a vessel speed corresponding to a condition other than the rotational position of the lever at the time at which the controller returns to the in-wave vessel speed control mode.

Figure 11:
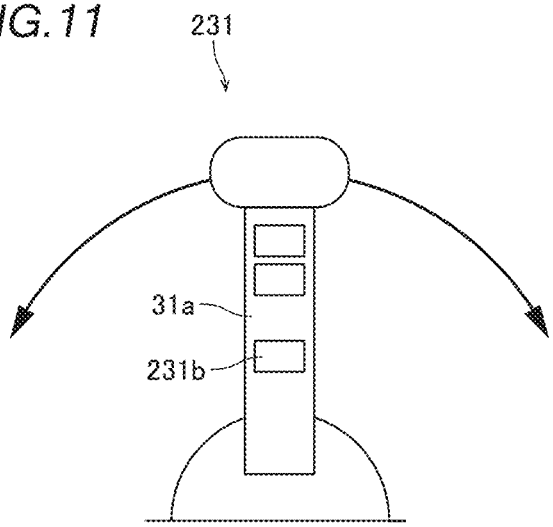
FIG. 11 is a schematic view showing a remote control lever assembly of a marine propulsion system according to a first modified example of the present invention.

While the controller 14 preferably temporarily cancels the in-wave vessel speed control mode for the predetermined period of time t when the rotational position of the lever 31*a* of the remote control lever assembly 31 is changed as an operation to cancel the in-wave vessel speed control mode in example embodiments described above, the present invention is not restricted to this. In an example embodiment of the present invention, as in a first modified example shown in FIG. 11, a remote control lever assembly 231 may alternatively include a cancel button 231*b* to receive an operation to cancel an in-wave vessel speed control mode in the in-wave vessel speed control mode, and a controller may alternatively temporarily cancel the in-wave vessel speed control mode for a predetermined period of time t when the cancel button 231*b* of the remote control lever assembly 231 is operated to cancel the in-wave vessel speed control mode. Accordingly, the operation to cancel the in-wave vessel speed control mode is performed using the cancel button 231*b*, which is provided exclusively to cancel the in-wave vessel speed control mode, separately from a lever 31*a* operated to adjust a vessel speed, and thus the possibility that a vessel user accidentally performs an operation other than the operation to cancel the in-wave vessel speed control mode when performing the operation to cancel the in-wave vessel speed control mode is reduced or prevented.

While the vessel speed adjustment operator preferably includes the remote control lever assembly 31 including the lever 31*a* to receive a change in the rotational position of the lever 31*a* as an operation to adjust the vessel speed V, and an operation to cancel the in-wave vessel speed control mode, and the controller 14 preferably temporarily cancels the in-wave vessel speed control mode for the predetermined period of time t when the remote control lever assembly 31 is operated to cancel the in-wave vessel speed control mode in example embodiments described above, the present invention is not restricted to this. In an example embodiment of the present invention, the vessel speed adjustment operator may alternatively include an operator (such as a joystick or a paddle operator (an operator on a steering wheel assembly operatable by a vessel user without taking his/her hands off the steering wheel assembly)) other than a remote control lever assembly, and the controller may alternatively temporarily cancel the in-wave vessel speed control mode for the predetermined period of time when the operator other than a remote control lever assembly is operated to cancel the in-wave vessel speed control mode.

Figure 12:
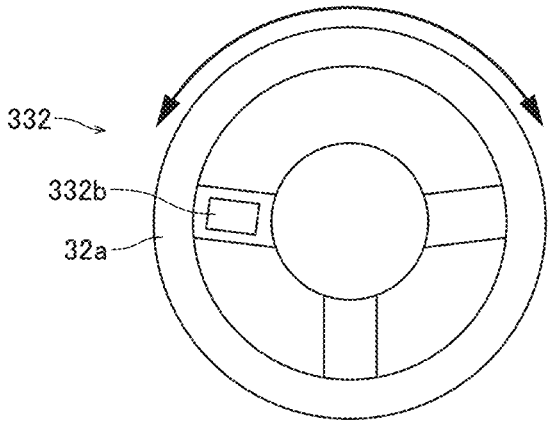
FIG. 12 is a schematic view showing a steering wheel assembly of a marine propulsion system according to a second modified example of the present invention.
Figure 13:
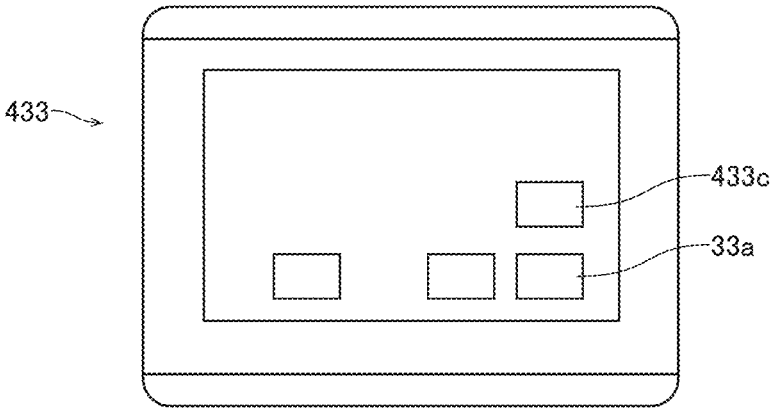
FIG. 13 is a schematic view showing a touch panel of a marine propulsion system according to a third modified example of the present invention.
Figure 14:
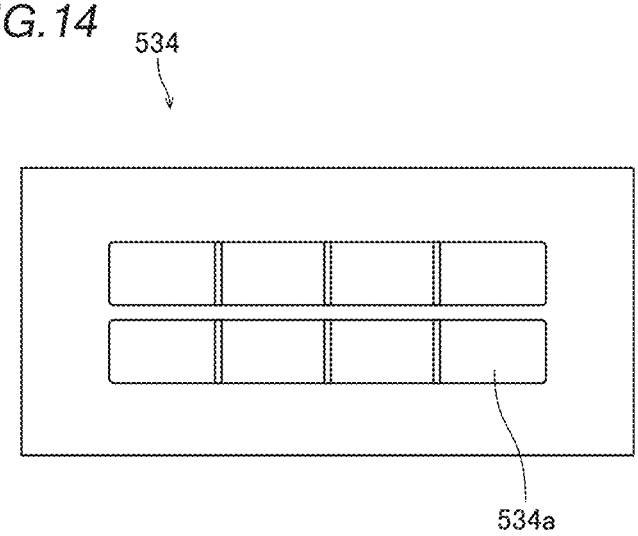
FIG. 14 is a schematic view showing a touch panel of a marine propulsion system according to a fourth modified example of the present invention.

While the operator 30 preferably includes the remote control lever assembly 31 (vessel speed adjustment operator) to receive an operation to adjust the vessel speed V and an operation to cancel the in-wave vessel speed control mode, and the controller 14 preferably temporarily cancels the in-wave vessel speed control mode for the predetermined period of time t when the remote control lever assembly 31 is operated to cancel the in-wave vessel speed control mode in example embodiments described above, the present invention is not restricted to this. In an example embodiment of the present invention, as in a second modified example shown in FIG. 12, the operator may alternatively include a steering wheel assembly 332 including a cancel button 332*b* and a wheel to receive a change in the rotational position of the wheel as an operation to adjust the steering angle of a propulsion device, and an operation to cancel the in-wave vessel speed control mode, and a controller may alternatively temporarily cancel the in-wave vessel speed control mode for the predetermined period of time t when the cancel button 332*b* of the steering wheel assembly 332 is operated to cancel the in-wave vessel speed control mode. Generally, the steering wheel assembly that receives a change in the rotational position of the wheel as the operation to adjust the steering angle of the propulsion device is located relatively close to a vessel user who is operating a marine vessel, and at a position at which the vessel user who is operating the marine vessel is able to operate the steering wheel assembly 332 practically without looking away from a direction in which the marine vessel is traveling. Therefore, the operation to cancel the in-wave vessel speed control mode is performed on the steering wheel assembly 332 that receives the operation to adjust the steering angle of the propulsion device, and thus the in-wave vessel speed control mode is canceled without the vessel user taking his/her hand off the steering wheel assembly 332 located relatively close to the vessel user or looking away from the traveling direction while operating the marine vessel, similarly to example embodiments described above. Consequently, the in-wave vessel speed control mode is temporarily canceled for the predetermined period of time easily and smoothly, similarly to example embodiments described above. Furthermore, in an example embodiment of the present invention, as in a third modified example shown in FIG. 13, the operator may alternatively include a touch panel 433 on which a cancel button 433*c* is displayed to receive an operation to cancel an in-wave vessel speed control mode, and a controller may alternatively temporarily cancel the in-wave vessel speed control mode for a predetermined period of time when the cancel button 433*c* displayed on the touch panel 433 is operated to cancel the in-wave vessel speed control mode. Accordingly, the operation to cancel the in-wave vessel speed control mode is performed on the cancel button displayed on the touch panel 433, and thus a vessel user performs the operation to cancel the in-wave vessel speed control mode while looking at the cancel button 433*c*. Consequently, the in-wave vessel speed control mode is temporarily canceled for the predetermined period of time visually and easily. Moreover, in an example embodiment of the present invention, as in a fourth modified example shown in FIG. 14, the operator may alternatively include a switch panel 534 including a plurality of physical switches that include a cancel button 534*a* to receive an operation to cancel an in-wave vessel speed control mode, and a controller may alternatively temporarily cancel the in-wave vessel speed control mode for a predetermined period of time when the cancel button 534*a* of the switch panel 534 is operated to cancel the in-wave vessel speed control mode. Accordingly, the cancel button 534*a* as a physical switch on the switch panel 534 is operated to cancel the in-wave vessel speed control mode, and thus once a vessel user remembers the position of the cancel button, he/she performs the operation to cancel the in-wave vessel speed control mode without looking at the cancel button. Consequently, the in-wave vessel speed control mode is temporarily canceled for the predetermined period of time easily.

While the controller 14 preferably returns to the in-wave vessel speed control mode when the predetermined period of time t has elapsed without any operation being performed on the operator 30 since the in-wave vessel speed control mode was temporarily canceled in example embodiments described above, the present invention is not restricted to this. In an example embodiment of the present invention, the controller may alternatively return to the in-wave vessel speed control mode when the predetermined period of time has elapsed regardless of whether or not an operation is performed on the operator since the in-wave vessel speed control mode was temporarily canceled.

While the controller 14 preferably returns to the in-wave vessel speed control mode when the predetermined period of time t has elapsed since the in-wave vessel speed control mode was temporarily canceled in example embodiments described above, the present invention is not restricted to this. In an example embodiment of the present invention, the controller may alternatively return to the in-wave vessel speed control mode when a condition other than the elapsed time from temporary cancellation of the in-wave vessel speed control mode is met after the in-wave vessel speed control mode is temporarily canceled.

While one propulsion device 20 is preferably attached to the stern 11 of the hull 10 in example embodiments described above, the present invention is not restricted to this. In an example embodiment of the present invention, more than one propulsion device may alternatively be attached to the stern of the hull.

While the propulsion device 20 preferably includes an outboard motor attached to the stern 11 of the hull 10 in example embodiments described above, the present invention is not restricted to this. In an example embodiment of the present invention, the propulsion device may alternatively include an inboard motor inside the hull or an inboard-outboard motor attached to the hull such that a portion of the inboard-outboard motor is inside the hull.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a propulsion device to be provided on a hull;

a controller configured or programmed to control driving of the propulsion device to adjust a vessel speed and perform an in-wave vessel speed control to adjust the vessel speed based on information regarding upward-downward movement of the hull; and an operator to receive an operation from a vessel user; wherein the controller is configured or programmed to temporarily cancel an in-wave vessel speed control mode, in which the in-wave vessel speed control is performed, for a predetermined period of time when the operator is operated to cancel the in-wave vessel speed control mode.

2. The marine propulsion system according to claim 1, wherein the controller is configured or programmed to return to the in-wave vessel speed control mode when the predetermined period of time has elapsed.

3. The marine propulsion system according to claim 2, wherein the controller is configured or programmed to return to the in-wave vessel speed control mode when the predetermined period of time has elapsed and without any operation being performed on the operator.

4. The marine propulsion system according to claim 1, wherein the operator includes a vessel speed adjustment operator to receive an operation to adjust the vessel speed and an operation to cancel the in-wave vessel speed control mode; and the controller is configured or programmed to temporarily cancel the in-wave vessel speed control mode for the predetermined period of time when the vessel speed adjustment operator is operated to cancel the in-wave vessel speed control mode.

5. The marine propulsion system according to claim 4, wherein the vessel speed adjustment operator includes a remote control lever assembly including a lever to receive a change in a rotational position of the lever as the operation to adjust the vessel speed, and the operation to cancel the in-wave vessel speed control mode; and the controller is configured or programmed to temporarily cancel the in-wave vessel speed control mode for the predetermined period of time when the remote control lever assembly is operated to cancel the in-wave vessel speed control mode.

6. The marine propulsion system according to claim 5, wherein the controller is configured or programmed to temporarily cancel the in-wave vessel speed control mode for the predetermined period of time when the rotational position of the lever of the remote control lever assembly is changed as the operation to cancel the in-wave vessel speed control mode.

7. The marine propulsion system according to claim 6, wherein the controller is configured or programmed to, after temporarily canceling the in-wave vessel speed control mode, return to the in-wave vessel speed control mode with the vessel speed corresponding to the rotational position of the lever at a time at which the controller returns to the in-wave vessel speed control mode.

8. The marine propulsion system according to claim 5, wherein the remote control lever includes a cancel button to receive the operation to cancel the in-wave vessel speed control mode; and the controller is configured or programmed to temporarily cancel the in-wave vessel speed control mode for the predetermined period of time when the cancel button of the remote control lever is operated to cancel the in-wave vessel speed control mode.

9. The marine propulsion system according to claim 1, wherein the operator includes a steering wheel assembly including a wheel to receive a change in a rotational position of the wheel as an operation to adjust a steering angle of the propulsion device, and an operation to cancel the in-wave vessel speed control mode; and the controller is configured or programmed to temporarily cancel the in-wave vessel speed control mode for the predetermined period of time when the steering wheel assembly is operated to cancel the in-wave vessel speed control mode.

10. The marine propulsion system according to claim 3, wherein the predetermined period of time is preset according to the vessel speed at a time at which the in-wave vessel speed control mode is temporarily canceled or information correlated to the vessel speed at the time at which the in-wave vessel speed control mode is temporarily canceled; and the controller is configured or programmed to return to the in-wave vessel speed control mode when the predetermined period of time has elapsed and without any operation being performed on the operator.

11. The marine propulsion system according to claim 3, wherein the operator includes a vessel speed adjustment operator to receive an operation to adjust the vessel speed and an operation to cancel the in-wave vessel speed control mode;

the predetermined period of time is preset according to a state of the vessel speed adjustment operator at a time at which the in-wave vessel speed control mode is temporarily canceled or a change in the state of the vessel speed adjustment operator at the time at which the in-wave vessel speed control mode is temporarily canceled; and the controller is configured or programmed to return to the in-wave vessel speed control mode when the predetermined period of time has elapsed and without any operation being performed on the vessel speed adjustment operator.

12. The marine propulsion system according to claim 1, wherein the operator includes a touch panel on which a cancel button is displayed to receive an operation to cancel the in-wave vessel speed control mode; and the controller is configured or programmed to temporarily cancel the in-wave vessel speed control mode for the predetermined period of time when the cancel button displayed on the touch panel is operated to cancel the in-wave vessel speed control mode.

13. The marine propulsion system according to claim 1, wherein the operator includes a switch panel including a plurality of physical switches that include a cancel button to receive an operation to cancel the in-wave vessel speed control mode; and the controller is configured or programmed to temporarily cancel the in-wave vessel speed control mode for the predetermined period of time when the cancel button of the switch panel is operated to cancel the in-wave vessel speed control mode.

14. The marine propulsion system according to claim 1, wherein the operator includes a mode start button to receive an operation to start the in-wave vessel speed control mode; and the controller is configured or programmed to:

start the in-wave vessel speed control mode when the mode start button is operated to start the in-wave vessel speed control mode; and temporarily cancel the in-wave vessel speed control mode for the predetermined period of time when the operator is operated, other than operating the mode start button, to cancel the in-wave vessel speed control mode.

15. The marine propulsion system according to claim 1, wherein the controller is configured or programmed to perform a notification control to notify the vessel user that the in-wave vessel speed control mode has been temporarily canceled when the in-wave vessel speed control mode has been temporarily canceled.

16. A marine vessel comprising:

a propulsion device on a hull;

a controller configured or programmed to control driving of the propulsion device to adjust a vessel speed and perform an in-wave vessel speed control to adjust the vessel speed based on information regarding upward-downward movement of the hull; and an operator to receive an operation from a vessel user; wherein the controller is configured or programmed to temporarily cancel an in-wave vessel speed control mode, in which the in-wave vessel speed control is performed, for a predetermined period of time when the operator is operated to cancel the in-wave vessel speed control mode.

17. The marine vessel according to claim 16, wherein the controller is configured or programmed to return to the in-wave vessel speed control mode when the predetermined period of time has elapsed.

18. The marine vessel according to claim 17, wherein the controller is configured or programmed to return to the in-wave vessel speed control mode when the predetermined period of time has elapsed and without any operation being performed on the operator.

19. The marine vessel according to claim 16, wherein the operator includes a vessel speed adjustment operator to receive an operation to adjust the vessel speed and an operation to cancel the in-wave vessel speed control mode; and the controller is configured or programmed to temporarily cancel the in-wave vessel speed control mode for the predetermined period of time when the vessel speed adjustment operator is operated to cancel the in-wave vessel speed control mode.

20. The marine vessel according to claim 19, wherein the vessel speed adjustment operator includes a remote control lever assembly including a lever to receive a change in a rotational position of the lever as the operation to adjust the vessel speed, and the operation to cancel the in-wave vessel speed control mode; and the controller is configured or programmed to temporarily cancel the in-wave vessel speed control mode for the predetermined period of time when the remote control lever assembly is operated to cancel the in-wave vessel speed control mode.

* * * * *